US011488570B2

(12) United States Patent
Feng et al.

(10) Patent No.: US 11,488,570 B2
(45) Date of Patent: Nov. 1, 2022

(54) SOUND ADSORBING MATERIAL AND SPEAKER BOX

(71) Applicant: AAC Technologies Pte. Ltd., Singapore (SG)

(72) Inventors: Hongshu Feng, Shenzhen (CN); Kun Tang, Shenzhen (CN); Jiqiang Dai, Shenzhen (CN); Hezhi Wang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 566 days.

(21) Appl. No.: 16/702,575

(22) Filed: Dec. 4, 2019

(65) Prior Publication Data

US 2020/0211524 A1 Jul. 2, 2020

(30) Foreign Application Priority Data

Dec. 29, 2018 (CN) ..... 201811637346.7

(51) Int. Cl.
*G10K 11/162* (2006.01)
*H04R 1/02* (2006.01)

(52) U.S. Cl.
CPC ..... *G10K 11/162* (2013.01); *H04R 1/025* (2013.01)

(58) Field of Classification Search
CPC ..... G10K 11/162; H04R 1/025
USPC ..... 181/294
See application file for complete search history.

(56) References Cited

U.S. PATENT DOCUMENTS

| | | | | |
|---|---|---|---|---|
| 10,506,333 | B2 * | 12/2019 | Wang | H04R 1/2876 |
| 10,785,586 | B2 * | 9/2020 | Liu | C01B 32/384 |
| 10,939,195 | B2 * | 3/2021 | Dai | B01J 20/186 |
| 11,028,023 | B2 * | 6/2021 | Cao | C04B 38/0054 |
| 11,109,149 | B2 * | 8/2021 | Feng | B01J 20/18 |
| 11,140,475 | B2 * | 10/2021 | Tang | C01B 39/04 |
| 11,356,768 | B2 * | 6/2022 | Feng | H04R 1/288 |

FOREIGN PATENT DOCUMENTS

| | | |
|---|---|---|
| CN | 104038855 A1 | 9/2014 |
| CN | 108996515 A1 | 12/2018 |

OTHER PUBLICATIONS

Ying Wu, Studies on the Syntheses of Zeolites from the Layered Aluminosilicate Materials, China Master's Theses Full-text Database, Dec. 31, 2013, pp. 14-15, 43-59.

(Continued)

*Primary Examiner* — Forrest M Phillips
(74) *Attorney, Agent, or Firm* — W&G Law Group

(57) ABSTRACT

The present application provides a sound adsorbing material, including a microporous material and an adsorbate gas adsorbed in the microporous material. The microporous material includes a zeolite molecular sieve, and the zeolite molecular sieve has a framework and extra-framework cations. An adsorption capacity of the adsorbolite molecular sieve to the adsorbate gas is greater than an adsorption capacity of the adsorbolite molecular sieve to air. The present disclosure further provides a speaker box adopting the sound adsorbing material. Compared with the related art, the sound adsorbing material provided by the present disclosure has good application effects, and the speaker box using the sound adsorbing material has a better low frequency acoustic performance.

11 Claims, 3 Drawing Sheets

A–A

(56) References Cited

OTHER PUBLICATIONS

3rd Office Action dated Jan. 5, 2021 by SIPO in related Chinese Patent Application No. 201811637346.7 (8 Pages).
1st Office Action dated Sep. 3, 2019 by SIPO in related Chinese Patent Application No. 201811637346.7 (14 Pages).
PCT search report dated Jan. 2, 2020 by SIPO in related PCT Patent Application No. PCT/CN2019/111293 (4 Pages).

* cited by examiner

SOUND ADSORBING MATERIAL AND SPEAKER BOX

TECHNICAL FIELD

The present disclosure relates to the technical field of sound adsorbing material, and in particular, to a sound adsorbing material and a speaker box employing the sound adsorbing material.

BACKGROUND

With the advance of science and technology and the improvement of living standards, electronic products are rapidly developed in many aspects such as energy saving, light weight, intelligence, information, multi-system, multi-function, and entertainment. As a result, higher requirements have been raised on performance and volume of the electronic products, and thus higher requirements are raised on a speaker box of the electronic product, especially the speaker box of a mobile phone, which is required to have a smaller size and also provide excellent sound quality.

The speaker box in the related art includes a housing having a receiving space, a speaker unit disposed in the housing, and a virtual acoustic cavity surrounded by the speaker unit and the housing. The virtual acoustic cavity is filled with a sound adsorbing material.

However, since an electronic consumer product is more compact, a rear cavity of the speaker box has a smaller volume, which will significantly reduce a response at low frequency band, thereby resulting in a poor sound quality. The sound adsorbing material is usually a microporous low-frequency improvement material (i.e., microporous material), such as activated carbon, zeolite and the like. Generally, the sound adsorbing material mainly adopts a porous carbon material of Panasonic Electronics and an MFI molecular sieve of Knowles Electronics, as well as FER and BEA molecular sieves and the like. The sound adsorbing material adsorbs the desorbed air in the rear cavity with its vibration along with the speaker unit of the speaker box, thereby increasing the volume of the virtual acoustic cavity, and thus increasing a response of the speaker box at a low frequency band. However, since the microporous material has a small adsorption capacity to air molecules at room temperature, the improvement on the response of the speaker at the low frequency band is limited.

Therefore, it is urgent to provide a new sound adsorbing material and a speaker box adopting the sound adsorbing material to solve the above technical problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will hereinafter be described in detail with reference to several exemplary embodiments. To make the technical problems to be solved, technical solutions and beneficial effects of the present disclosure more apparent, the present disclosure is described in further detail together with the figure and the embodiments. It should be understood the specific embodiments described hereby is only to explain the disclosure, not intended to limit the disclosure.

Figure 1:
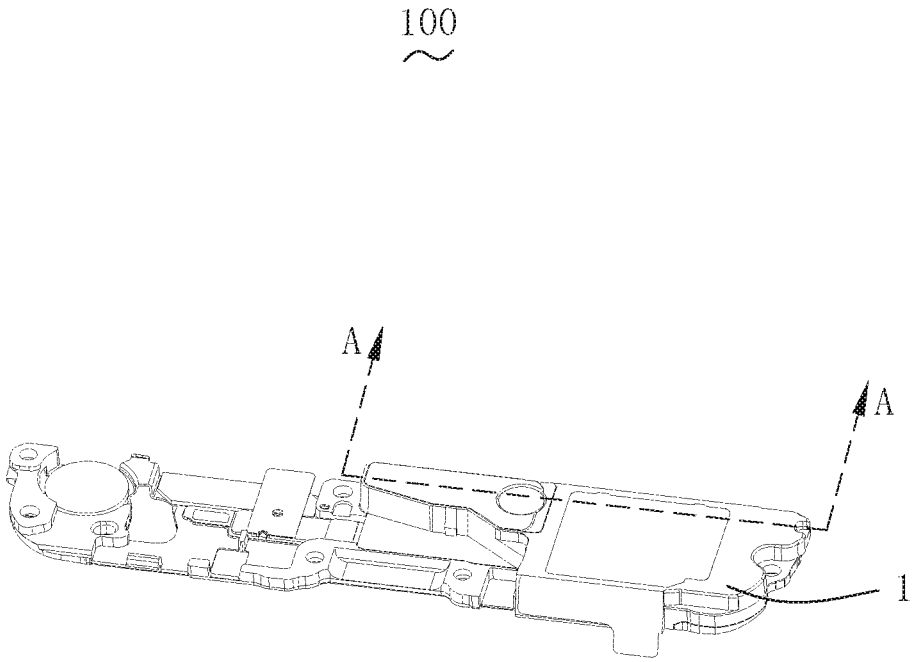
FIG. 1 is a schematic perspective diagram of a speaker box in an embodiment of the present disclosure.
Figure 2:
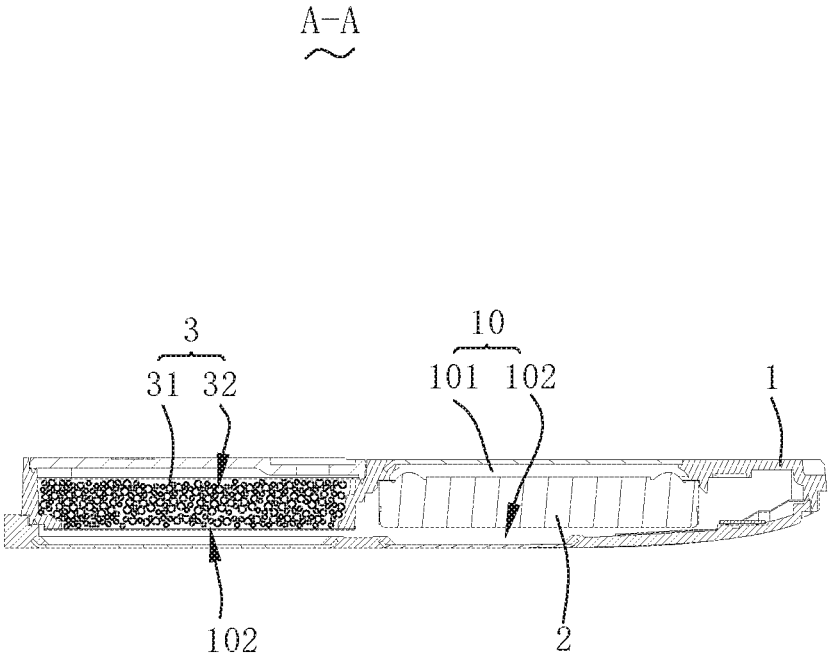
FIG. 2 is a schematic exploded view of a speaker box in an embodiment of the present disclosure.

With reference to FIG. 1 and FIG. 2, the present disclosure provides a speaker box 100, which includes a housing 1 having a receiving space 10, and a speaker unit 2 disposed in the housing 1. The speaker unit 2 divides the receiving space 10 into a front cavity 101 and a rear cavity 102. The rear cavity 102 is filled with a sound adsorbing material 3. The rear cavity 102, as a virtual acoustic cavity, can improve a low frequency acoustic performance of the speaker box 100.

The present disclosure further provides a sound adsorbing material 3, including a microporous material 31 and an adsorbate gas 32 adsorbed to the microporous material 31. The adsorbate gas 32 is a gas which is adsorbed with a greater amount than air. The adsorbate gas 32 can be quickly adsorbed and desorbed by the microporous material 31. For example, the microporous material 31 adsorbs and desorbs the adsorbate gas 32 with the vibration of the speaker unit 2, thereby increasing a gas volume of the rear cavity 102, and thus improving a response of the speaker box 100 at a low frequency band.

The microporous material 31 includes a zeolite molecular sieve, which contains at least 85 wt % of silica, and the zeolite molecular sieve has a framework and extra-framework cations. An adsorption capacity of the adsorbolite molecular sieve to the adsorbate gas is greater than an adsorption capacity of the adsorbolite molecular sieve to air. In this embodiment, the molecular sieve is a silicon-containing zeolite molecular sieve having a plurality of micropores. The zeolite molecular sieve has a micropore diameter in a range of 0.35 nm to 2 nm. The silicon-containing zeolite molecular sieve is a microporous material having less extra-framework cations, unobstructed pores and good stability. The microporous material is not limited thereto, and other materials such as porous carbon and silica can also be used.

The zeolite molecular sieve includes has a structure selected from any one of MFI, FER, BEA, CHA, MEL, MOR, and FAU. A content of the extra-framework cations in the microporous material 31 is, for example, less than 10 wt %. When the content of the extra-framework cations in the microporous material is less than 6 wt %, the microporous material 31 has a particularly good effect. When the content of the extra-framework cations in the microporous material is less than 3 wt %, the microporous material 31 has the best effect A content of silica is at least 90 wt %. In other embodiments, when the content of silica is at least 95 wt %, the microporous material 31 has the best effect.

The adsorbate gas 32 is selected from the group consisting of $N_2$, $CO_2$, $SF_6$, $C_2H_8$, $C_2H_6$, and combinations thereof. The adsorption capacities to $CO_2$, $C_2H_8$, and $C_2H_6$ are greater than that to air, and they can be quickly adsorbed and desorbed, and thus have better effect. In this embodiment, the adsorbate gas 32 is $CO_2$, and each test data reveal the optimal effect.

In this embodiment, the adsorbate gas 32 in the rear cavity 102 is adsorbed and desorbed with the vibration of the speaker unit 2 of the speaker box 100, thereby increasing the volume of the rear cavity 102, and thus increasing the response of the speaker box at a low frequency band.

In order to verify the effect of the adsorbate gas 32 for improving the low frequency acoustic performance of the speaker box 100 in the present disclosure, following three comparison tests are performed.

Test I: test for comparing effects of silicon-containing zeolite molecular sieves with different structures when the adsorbate gas 32 is $CO_2$. The test is described as follows.

1) Test Conditions

Comparison tests were performed by providing $CO_2$ as the adsorbate gas 32 or air into the rear cavity 102; and, as the microporous material 31, using silicon-containing zeolite molecular sieves respectively having four structures: MFI, MEL, BEA, and CHA.

The specific process is described as follows: in absence of the adsorbate gas (when air is present inside the rear cavity 102), a temperature was 24° C., a test voltage was 0.5V, f0 of the virtual acoustic cavity of the box speaker is 946 Hz, and a resonant frequency f0 was decreased to be 780 Hz after adding 0.2 g of the silicon-containing zeolite molecular sieve with MFI structure as a low frequency improvement material; then the speaker box 100 was placed into $CO_2$ atmosphere, and the resonant frequency f0 was decreased to be 632 Hz. The other comparison tests are performed similarly except the silicon-containing zeolite molecular sieves have the MEL, BEA, and CHA structures.

2) Test Results

Through the comparison tests, when the adsorbate gas 32 was $CO_2$, the low frequency improvement effect of the speaker box 100 can be significantly enhanced, referring to Table 1.

TABLE 1 effect comparison test data in terms of silicon-containing zeolite molecular sieve with different structures when the adsorbate gas 32 was CO2

| Microporous material | Adsorbate gas | Resonant frequency f0/Hz |
|---|---|---|
| No microporous material, i.e., empty cavity | Air | 946 |
| | $CO_2$ | 908 |
| Silicon-containing zeolite molecular sieve with MFI structure | Air | 780 |
| | $CO_2$ | 632 |
| Silicon-containing zeolite molecular sieve with MEL structure | Air | 784 |
| | $CO_2$ | 630 |
| Silicon-containing zeolite molecular sieve with BEA structure | Air | 810 |
| | $CO_2$ | 640 |
| Silicon-containing zeolite molecular sieve with CHA structure | Air | 792 |
| | $CO_2$ | 624 |

Test II: effect comparison tests of impedance curves measured by changing voltage. The tests are described in details as follows.

1) Test conditions

Comparison tests were performed by providing $CO_2$ as the adsorbate gas 32 or air into the rear cavity 102; and the comparison tests were performed when the rear cavity was empty or filled with 0.2 g of the silicon-containing zeolite molecular sieve with the MFI structure as the microporous material 31.

The specific process was to change the voltage and adjust the test voltage to 2V, then measure the impedance curve thereof, and record the resonant frequencies f0 and Δf0.

2) Test Results

Through the comparison tests, when the adsorbate gas 32 was $CO_2$, the low frequency improvement effect of the speaker box 100 can be significantly enhanced. For details, please refer to FIG. 3 and Table 2.

TABLE 2 effect comparison test data in terms of different impedance curves

Figure 3:
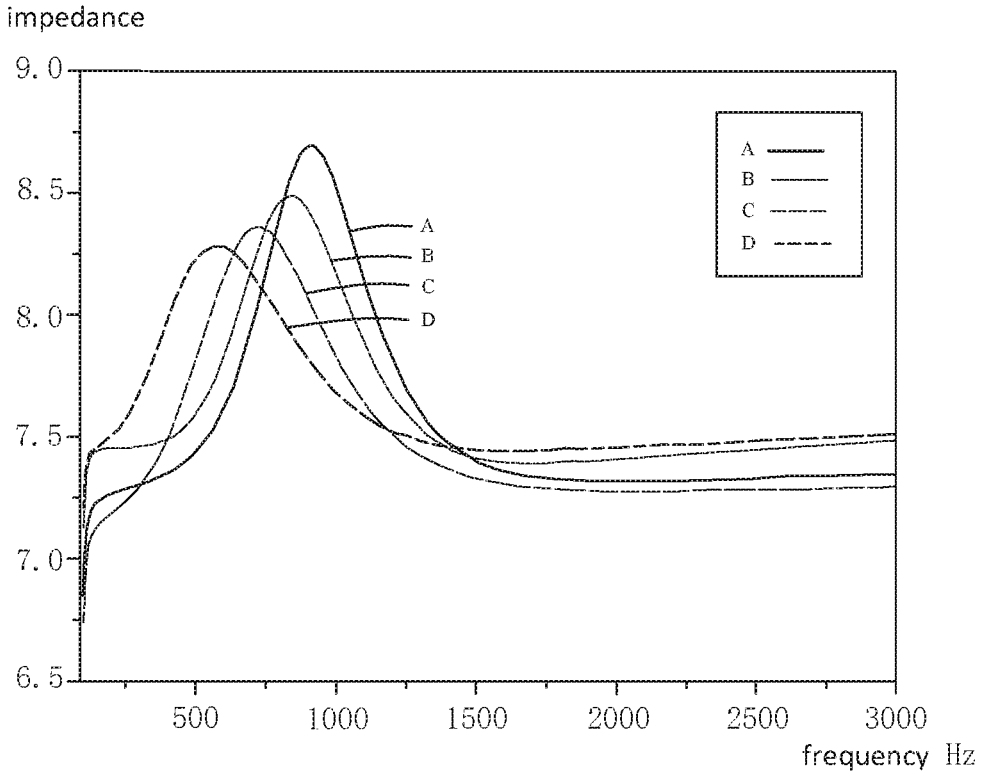
FIG. 3 is an impedance diagraph of a comparison test for verifying the present disclosure.

| Impedance curves in FIG. 3 | Test conditions: Voltege | Microporous material | Adsorbate gas | Resonant frequency f0/Hz | ΔF0/Hz |
|---|---|---|---|---|---|
| A | 2 V | Empty cavity | Air | 928 | 0 |
| C | 2 V | 0.2 g of silicon-containing zeolite molecular sieve with MFI structure | Air | 736 | 190 |
| B | 2 V | Empty cavity | $CO_2$ | 863 | 65 |
| D | 2 V | 0.2 g of silicon-containing zeolite molecular sieve with MFI structure | $CO_2$ | 588 | 863 − 588 = 275 |

Test III: effect comparison tests under increased test temperature. The tests are described in details as follows.

1) Test Conditions

Comparison tests were performed by providing $CO_2$ as the adsorbate gas 32 or air into the rear cavity 102; comparison tests were performed when the rear cavity was empty or filled with 0.2 g of the silicon-containing zeolite molecular sieve with the MFI structure as the microporous material 31; two test voltages: 100 mV and 2V, and a test temperature was 35° C.

The test temperature was adjust to 35° C. to perform the comparison tests, and then record the resonant frequencies f0 and Δf0.

2) Test Results

Through the comparison tests, when the adsorbate gas 32 was CO2, the low frequency improvement effect of the speaker box 100 can be significantly enhanced. For details, please refer to Table 3.

TABLE 3 effect comparison test data when test temperature was increased

| Test conditions (temperature 35° C.) | | | | Resonant | |
|---|---|---|---|---|---|
| No. | Voltage | Adsorbate gas | Microporous material | frequency f0/Hz | Δf0/Hz |
| 1 | 100 mV | Air | Empty cavity | 926 | |
| 2 | 2 V | Air | Empty cavity | 902 | |
| 3 | 100 mV | Air | 0.2 g of silicon-containing zeolite molecular sieve with MFI structure | 763 | 163 |
| 4 | 2 V | Air | 0.2 g of silicon-containing zeolite molecular sieve with MFI structure | 713 | 189 |
| 5 | 100 mV | $CO_2$ | Empty cavity | 857 | 69 |
| 6 | 2 V | $CO_2$ | Empty cavity | 845 | 57 |
| 7 | 100 mV | $CO_2$ | 0.2 g of silicon-containing zeolite molecular sieve with MFI structure | 597 | 857 − 597 = 260 |
| 8 | 2 V | $CO_2$ | 0.2 g of silicon-containing zeolite molecular sieve with MFI structure | 544 | 845 − 544 = 301 |

Remarks: it can be seen from the test result data of No. 7 that Δf0 of the rear cavity 102 when the adsorbate gas 32 was $CO_2$ is increased by 59.5% than that when the rear cavity was filled with air; and it also can be seen from the test result data of No. 8 that Δf0 of the rear cavity 102 when the adsorbate gas 32 was $CO_2$ is increased by 59.3% than that when the rear cavity was filled with air.

Through the above three comparison tests, it can be concluded from the test data that, in the present disclosure, the rear cavity 102 of the speaker box 100 filled with the sound adsorbing material 3, especially the microporous material 31 and the adsorbate gas 32, can effectively improve the low frequency acoustic performance of the speaker box 100.

Compared with the related art, in the present disclosure, regarding the sound adsorbing material, the adsorption capacity of the microporous material to the adsorbate gas is greater that the adsorption capacity to air, for replacing the air molecules in the rear cavity. When the sound adsorbing material is applied to the speaker box, the low frequency acoustic performance of the speaker box can be significantly improved.

The above described embodiments are merely intended to illustrate the present disclosure, and it should be noted that, without departing from the inventive concept of the present disclosure, the improvements made by those skilled in the related art shall fall within the protection scope of the present disclosure.

What is claimed is:

1. A sound adsorbing material, comprising:

a microporous material; and an adsorbate gas adsorbed in the microporous material, wherein the microporous material comprises a zeolite molecular sieve containing at least 85 wt % of silica, and the zeolite molecular sieve comprises a framework and extra-framework cations, and an adsorption capacity of the zeolite molecular sieve to the adsorbate gas is greater than an adsorption capacity of the zeolite molecular sieve to air.

2. The sound adsorbing material as described in claim 1, wherein the zeolite molecular sieve has a micropore diameter in a range of 0.35 nm to 2 nm.

3. The sound adsorbing material as described in claim 2, wherein the zeolite molecular sieve has a structure selected from any one of MFI, FER, BEA, CHA, MEL, MOR, or FAU.

4. The sound adsorbing material as described in claim 1, wherein a content of the extra-framework cations is less than 10 wt %.

5. The sound adsorbing material as described in claim 4, wherein a content of the extra-framework cations is less than 6 wt %.

6. The sound adsorbing material as described in claim 5, wherein a content of the extra-framework cations is less than 3 wt %.

7. The sound adsorbing material as described in claim 1, wherein a content of the silica is at least 90 wt %.

8. The sound adsorbing material as described in claim 7, wherein the content of the silica is at least 95 wt %.

9. The sound adsorbing material as described in claim 1, wherein the adsorbate gas is selected from the group consisting of $N_2$, $CO_2$, $SF_6$, $C_2H_6$ and combinations thereof.

10. The sound adsorbing material as described in claim 9, wherein the adsorbate gas is $CO_2$.

11. A speaker box, comprising:

a housing having a receiving space; and a speaker unit disposed in the housing, wherein the speaker unit divides the receiving space into a front cavity and a rear cavity, and the rear cavity is filled with the sound adsorbing material as described in claim 1.

* * * * *